United States Patent [19]

Nicholson

[11] 4,190,924

[45] Mar. 4, 1980

[54] ANIMAL GROOMING DEVICE

[76] Inventor: James A. Nicholson, 10600 Van Stralen Way, Rancho Cordova, Calif. 95670

[21] Appl. No.: 841,061

[22] Filed: Oct. 11, 1977

[51] Int. Cl.[2] ..... A47L 9/06

[52] U.S. Cl. ..... 15/402; 119/83

[58] Field of Search ..... 119/83, 84; 15/401, 15/402, 393, 421

[56] References Cited

U.S. PATENT DOCUMENTS 1,083,087 12/1913 Griffiths ..... 15/402

FOREIGN PATENT DOCUMENTS 951597 10/1956 Fed. Rep. of Germany ..... 15/402

*Primary Examiner*—Louis G. Mancene

*Assistant Examiner*—Daniel J. Leach

[57] ABSTRACT

Animal grooming device comprising, a hexagonally-shaped flat top with a downwardly extending skirt from said top and forward extensions with said skirt having disposed circular apertures, extended triangular slots in combination with alternately placed triangular notches, a center strip with the aforesaid apertures, slots and notches attached to said top to provide two horizontal open suction chambers, a rearward closed skirt casing comprising, an attachable cylindrical nozzle and a forward facing triangular plate having laterally-placed triangular notches.

1 Claim, 4 Drawing Figures

ANIMAL GROOMING DEVICE

REFERENCE

It appears the arts have not provided a curry-brush (comb) which is suitable for continuous and effective grooming application without the tool becoming cloged with hair thereby, creating excessive clean-up and wasted motion, to include time, specifically, the D. L. Griffiths application #1,083,087 dtd 12/30/13 provides a plurality of circular apertures, in a flat surface, as the primary airways to an inner suction chamber therefore, the use of apertures, in this manner, inhibits long and shedding patched hair clogging and the problem is further complicated by providing an inner clog prone chamber. The K. Pause application 190 951,597 dtd 10/31/56 also, has the same clogging problem by the use of apertures as the primary airway into the suction chamber however, the chamber does not further complicate the clogging problem, as in the above mode, if indeed the hair ever reaches the apertures since, the apertures are offset from pulling alignment between the conical teeth the suction airways most likely pick up hair on the round trip since again, the conical teeth hold the hair pass the airways and in this manner causing considerable objective inefficiency and excessive workload and lost time.

SUMMARY

The objects of this curry-brush is to provide contiuous and efficient clog free grooming for all types of animal hair with no restrictions to type therefor. The inner hollow twin horizontal suction chambers are the primary airways and provide unrestrictive discharge into the rear nozzle thereby, eliminating clogging, reducing grooming time, wasted motion and excessive clean-up. Also, the object of apertures, as used in this application, are in conjunction with hair pulling slots which loosen hair thereby, increasing the efficiency of the curry-brush and leave the brush cleaner upon completion of the grooming process. Further, the triangle shape of the skirt and the center strip provides pliability to the lower ends of said skirt and strip thereby, creating a wavering and pulling motion . . . much like brushing, for more effective grooming. A lateral line of rear blunt and slotted triangle teeth enhance loosening of hair, dirt and scaly skin also, the blunt ends reduce excessive skin irritation.

In the Views.

Figure 3:
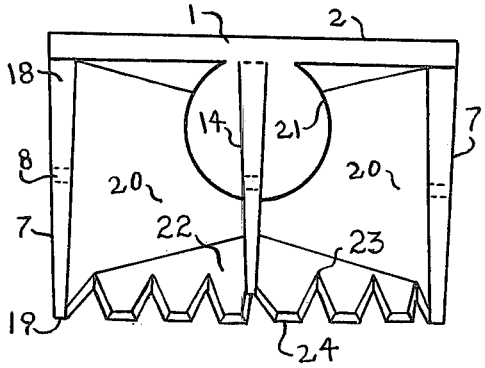

FIG. 3. is a frontal rear casing cut-a-way view.

Figure 4:
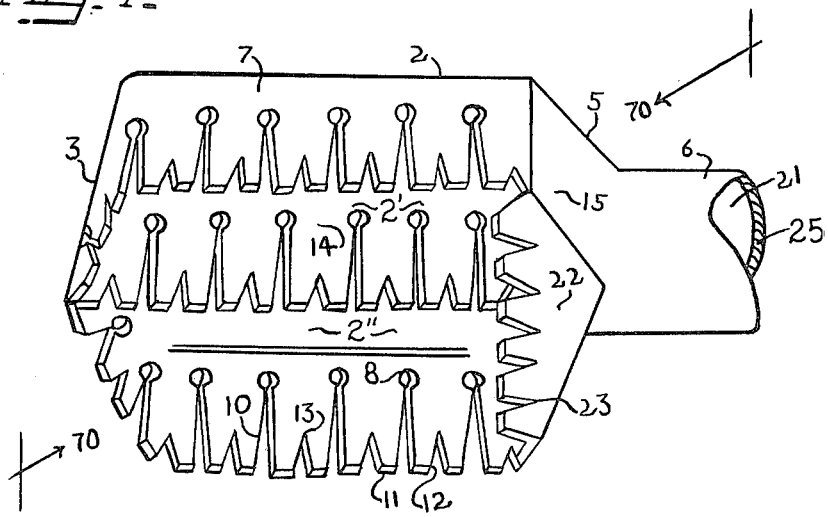

FIG. 4 is an angled view of the grooming device.

DETAILED DESCRIPTION

It is preferred the animal grooming device be fabricated by using molding principles and with platic and/or synthetic rubber materials.

Figure 1:
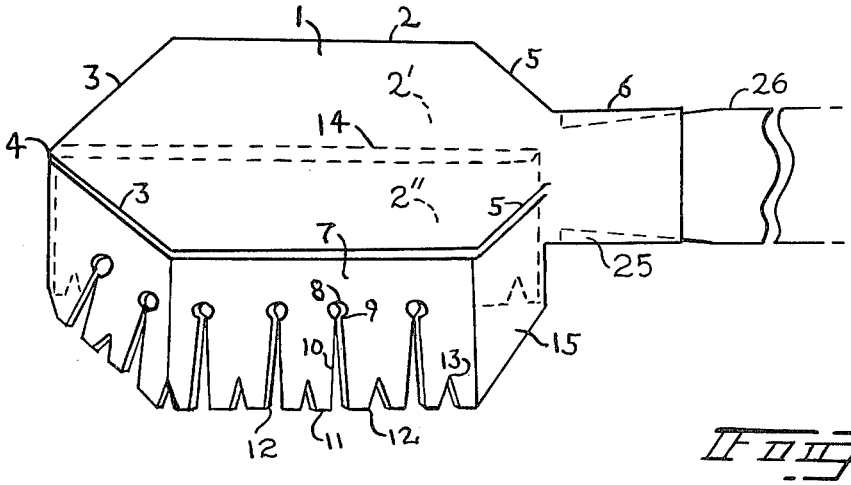
FIG. 1 is a side embodiment of the animal grooming device.
Figure 2:
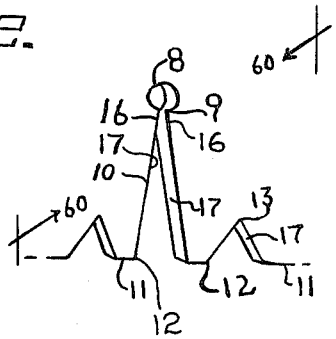
FIG. 2 is an enlarged view showing is a fragment of the skirt.

The operable mode for the animal grooming device is to attach the rearward cylindrical nozzle 6 to a common home or shop vacuum cleaner suction hose 26, in a manner 25 later described. The grooming device is manually operated by hand and by gripping the parallel sides and using downward motion the animal's coat is brushed and with upward motion the coat is ruffed for absolute grooming. The main section of this device has a flat elongated top 1 wherein, the parallel sides 2 spaced apart have forward extensions 3 diagonally inward of each other and are joined to form an apex 4 and rearward of said parallel sides also, diagonal inward extension 5 are provided in a spaced apart relationship to form a hexagonally-shaped top 1. The parallel sides provide hand gripping of said grooming device. The rearward, spaced apart, diagonal extensions 5 culminate in a rearward, horizontally-placed, cylinder-shaped suction nozzle 6 which is attachable to a suction hose of a vacuum cleaner. Attached to and extending downward from said top parallel sides 2 and the forward extensions 3, including the apex 4, a vertical elongated rigid skirt 7 is provided which comprises a plurality of horizontally-disposed, spaced apertures 8 each open at its lower end 9 and extending from said end vertically downward to the base of said skirt 7, a plurality of extended triangular shaped slots 10, horizontally-disposed apart also, in alternate spacing, between said slots, and downwardly near the base of said skirt, a plurality of triangular shaped notches 13 extending to the end of the skirt 7. A horizontal elongated strip 14, is provided and the strip comprises the aforedescribed apertures, slots and notches with the said strip attached to the transverse side of the top 1 and attached vertically to the forward apex 4 inwardly with said strip extending downward. In this manner, the aforesaid parallel sides 2 are divided into two horizontal open hollow chambers 2'–2 within the confines of said skirt 7. These open hollow chambers are designed to provide unrestricted suction airflow into the attachable discharge nozzle 6 which in turn is attached to a vacuum cleaner hose 26. The aforesaid rearward extensions 5 culminate into said rearward horizontal suction nozzle 6, wherein said nozzle sides and base of said cylindrical shape are incorporated into a downwardly extending rear end of the skirt 7 which does not have the said apertures, slots and notches. A rear skirt closed casing 15 is provided. In this manner all airway suction must come from the forward two chambers. The enlargement of the skirt section is indicative of all said apertures, slots and notches, and also an understanding their function. The plurality of horizontally-disposed, spaced circular apertures 8 are each open at their base 9 in close proximity leading diagonally downward to the opposing sides 16 of an extended triangular shaped slot 10 which are spaced apart at the end. Also, the inner sides of said slots have rectangularly blunt opposing sides 17 and disposed alternately between all said slots 10 and downwardly adjacent a plurality of, spaced triangular shaped notches 13, spaced apart at their ends 12 with the inner opposing sides 17. This manner, the extended slots allow hair to be pulled between, when brushing the animals coat and with the close proximity of the opposing sides, at the top, accumulations of hair push upward and the hair is drawn into the apertured suction airway and into the discharge stream. The lower notches offset and divide the hair for thorough cleaning of the animal's coat since a smoothly brushed coat after minor brushing, defeats the grooming purpose of removing hair, dirt and scaly skin from the animal's coat. The rearward inner cut-a-way view of FIG. 3 of the closed skirt casing 15 of FIG. 1. is indicative of the top, suction inner nozzle and center strip wherein the rear casing base is attached to a horizontally placed triangular shaped plate. However, it is to be noted that the vertically placed skirt 7 sides are wider at the top 18 to give strength to the upper body of said skirt and extending downward to said skirt end 19 the skirt is inwardly smaller. Also, this downward graduation applies in the construction of the center strip 14. The cut-away is indicative of the said top extensions in attachment with the rear closed skirt inner casing 20 and in attachment with the cylindrical forward rim 21 of said suction nozzle, and to completely enclose the aforesaid parts a triangular shaped plate 22 is provided and attached horizontally to the vertical skirt base end and the said plate 22 extends inwardly from the rearward extension 5 to approximately the parallel top ends. In this manner, a closed hollow rear casing is provided to contain the suction air stream and, the forward end of said plate is provided with a laterally-placed series of triangularly shaped notches 23 with the ends spaced apart to form laterally extending rectangular shaped blunt ends 24 between said notches. In this manner, forward motion of the grooming device causes the said notched plate to ruff the animal's hair in the opposite direction of growth, thereby greatly enhancing the removal of dirt, hair and scaly skin and, the blunt ends of said notches will not irritate the animals skin. The angled underside view of FIG. 4 of the aminal grooming device is relative to all parts in attachment. The plurality of horizontal rectangular shaped blunt bases 11 between said slots and notches are designed so as not to irritate the animals skin during the grooming process. As indicated in FIG. 1., the horizontal rearward cylindrical suction nozzles 6 inner thickness is inwardly graduated to form a cylindrical wedge 25 within said nozzle thereby, insuring a snug and tight friction fit when the vacuum cleaner hose 26 is inserted.

What I claim is:

1. An improvement in a grooming brush comprising a main section including a flat top portion formed with parallel sides, forward extensions of the sides extending diagonally inwardly toward each other and meeting to form a forward apex, rearward extensions of the sides extending diagonally inwardly toward each other but having spaced ends, all sides and extensions thus forming a generally hexagonally-shaped top portion, a rigid skirt extending vertically downward from the sides and extensions of the top portion, the sides and forward extensions of the skirt being provided with a plurality of horizontally-disposed, spaced circular apertures, each aperture having a narrow opening ar its lower end leading into a triangular slot which extends to the base of the skirt, a plurality of triangular notches disposed between said triangular slots at the base of the skirt, a longitudinal center strip attached to and extending vertically downwardly from the flat top portion dividing said brush into twin chambers, said strip being provided with spaced apertures, open-ended triangular slots, and open-end triangular notches, a triangular shaped plate attached to the rearward end of the skirt, said plate having a series of notches therein, and a cylindrical nozzle extending horizontally from the rearward end of the rear extensions of the flat top portion and skirt to receive the end of a vacuuming hose.

* * * * *